US008701223B2

(12) United States Patent
Miller et al.

(10) Patent No.: US 8,701,223 B2
(45) Date of Patent: Apr. 22, 2014

(54) SINK WITH IMPROVED RIM FEATURES

(75) Inventors: Jason R. Miller, Sheboygan Falls, WI (US); Niels J. Eilmus, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 443 days.

(21) Appl. No.: 13/009,627

(22) Filed: Jan. 19, 2011

(65) Prior Publication Data

US 2012/0159703 A1 Jun. 28, 2012

Related U.S. Application Data

(60) Provisional application No. 61/426,905, filed on Dec. 23, 2010.

(51) Int. Cl.
*A47K 1/04* (2006.01)
*A47K 1/00* (2006.01)

(52) U.S. Cl.
CPC ..... *A47K 1/00* (2013.01)
USPC ..... 4/619

(58) Field of Classification Search
USPC ..... 4/353, 416, 619
See application file for complete search history.

(56) References Cited

U.S. PATENT DOCUMENTS

| | | | | |
|---|---|---|---|---|
| 2,080,573 | A * | 5/1937 | Sern | 4/631 |
| 3,034,146 | A * | 5/1962 | Lyon | 4/650 |
| 3,034,148 | A * | 5/1962 | Lyon | 4/635 |
| 3,555,577 | A | 1/1971 | Drain | |
| 4,624,020 | A | 11/1986 | Abderhalden et al. | |
| 5,016,297 | A | 5/1991 | Sauter et al. | |
| D326,711 | S | 6/1992 | Lotito et al. | |
| 5,642,755 | A | 7/1997 | Mark et al. | |
| 6,049,921 | A | 4/2000 | Erbs | |
| 6,349,429 | B1 * | 2/2002 | Zurba et al. | 4/661 |
| 7,278,176 | B2 | 10/2007 | Clarke | |
| D556,298 | S | 11/2007 | Sutopo | |
| D556,299 | S | 11/2007 | Sutopo | |
| D559,366 | S | 1/2008 | Chong | |
| 2007/0011806 | A1 | 1/2007 | Knowlton | |
| 2008/0148475 | A1 | 6/2008 | Lin | |
| 2010/0017956 | A1 | 1/2010 | Chen | |

FOREIGN PATENT DOCUMENTS

| | | | |
|---|---|---|---|
| DE | 20 2009 009704 U1 | | 12/2009 |
| DK | 202009009704 | * | 12/2009 |

OTHER PUBLICATIONS

PCT International Search Report and Written Opinion for International Application No. PCT/US2011/064707; dated Mar. 16, 2012; 13 pages.
Web site excerpt from Kohler.com for Executive Chef undercounter kitchen sink, K-5931-4U, admitted prior art.
Web site excerpt from FaucetDirect.com for Elkay ELU2118 Contemporary/Modern single basin stainless steel kitchen sink, admitted prior art.

(Continued)

*Primary Examiner* — Lori Baker
(74) *Attorney, Agent, or Firm* — Foley & Lardner LLP

(57) ABSTRACT

A sink mountable to an underside of a counter, an assembly including this sink, a method installing this sink, and a method of manufacturing this sink are disclosed. The sink includes at least one basin with a rim extending generally outwardly from an upper boundary of the basin. The rim includes at least one channel recessed relative to an upper surface of the rim. Among other things, this channel may strengthen and inhibit warping of the rim as well as be configured to neatly receive a sealant during installation.

23 Claims, 6 Drawing Sheets

(56) References Cited

OTHER PUBLICATIONS

Six pages of a 2009 Sterling installation instructions, admitted prior art.

International Preliminary Report on Patentability in Application No. PCT/US2011/064707 mailed Jul. 4, 2013.

* cited by examiner

SINK WITH IMPROVED RIM FEATURES

CROSS-REFERENCE TO RELATED APPLICATION

This patent application claims priority to U.S. provisional patent application Ser. No. 61/426,905 entitled "Sink with Improved Rim Features" filed on Dec. 23, 2010. The full contents of that application are incorporated by reference as if set forth in its entirety herein.

BACKGROUND

This disclosure relates to sinks. More particularly, this disclosure relates to undercounter mountable sinks.

SUMMARY

A sink mountable to an underside of a counter, an assembly including this sink, a method of installing this sink, and a method of manufacturing this sink are disclosed. The sink includes at least one basin with a rim extending generally outwardly from an upper boundary of the basin. The rim includes at least one channel recessed relative to an upper surface of the rim.

Among other things, this channel may strengthen and inhibit warping of the rim as well as be configured to neatly receive a sealant, such as silicone caulk, during installation. The presence of the channel can strengthen and inhibit warping of the rim in comparison to a similar sink lacking this channel. The improved planarity of the rim facilitates convenient and hassle-free installation of the sink.

In some forms, the sink may be a drawn, stainless steel sink. The channel may be a strengthening element and/or may reduce warping of the rim. This channel may be integrally formed in the rim. In some forms the channel may form a closed loop around the at least one basin, while in other forms the channel may extend only partially around the basin.

The rim may further include a mounting portion and the channel may be formed in this mounting portion. The channel may be a plurality of channels that extend along portions of the mounting portion of the rim.

The rim may further include a faucet deck. The faucet deck may be disposed generally between a portion of the upper boundary of the basin or basins and an outer periphery of the rim. The channel may extend at least along a portion of the mounting portion of the rim generally corresponding to the faucet deck.

The rim may further include an upper surface. A first portion of the upper surface of the rim at the mounting portion generally exterior to the channel may be substantially coplanar with a second portion of the upper surface of the rim at the mounting portion generally interior to the channel.

In some forms, a protrusion may extend generally downwardly from an underside surface of the rim. This protrusion may be generally beneath the channel.

A sink of this type may be mounted to an underside of a counter to form an assembly. In the assembly, the sink includes at least one basin and a rim extending generally outwardly the basin. The rim includes at least one channel recessed relative to an upper surface of the rim.

A sealant may be disposed in the channel and help to form a seal between the rim and the underside of the counter.

In one form, the rim may be substantially planar.

The rim may further include a protrusion extending generally downward from an underside surface of the rim. At least one mounting element may help to support the sink with respect to the counter being positioned at least partially over the protrusion and generally below the channel.

A related method of installing a sink of this kind to an underside of a counter is also disclosed. According to this method, a sink is provided with at least one basin and a rim extending generally outward from an upper boundary of the basin or basins. The rim includes an upper surface, a mounting portion, and at least one channel recessed relative to a portion of the upper surface generally corresponding to the mounting portion of the rim. The sink is positioned such that the mounting portion of the rim substantially contacts the underside of the counter.

The method may further include the step of placing a sealant in the channel before positioning the sink such that the mounting portion of the rim substantially contacts the underside of the counter.

One or more mounting elements may help support the sink relative the counter. Some mounting elements may include a first end in contact with the underside of the counter and a second end in contact with the underside of the rim at a location generally interior relative to the channel.

A method of manufacturing a sink configured to be mounted to an underside of a counter is also disclosed. The method includes drawing a stainless steel sheet to form at least one basin and a rim extending generally outwardly from an upper boundary of the basin. A channel is also formed in a mounting portion of the rim. This channel is recessed relative to an upper surface of the rim.

The steps of drawing the stainless steel sheet and forming the channel may occur substantially simultaneously or may occur generally sequentially.

The step of drawing the stainless steel sheet to form at least one basin and a rim may include forming a basin having at least some large corner radii, thereby improving the flow of stainless steel during the drawing step.

The step of forming the channel may further include minimizing warping of the upper surface of the rim. One or more water distribution element or water distribution controls may further be mounted to a faucet deck which is part of the rim.

DETAILED DESCRIPTION

Figure 1:
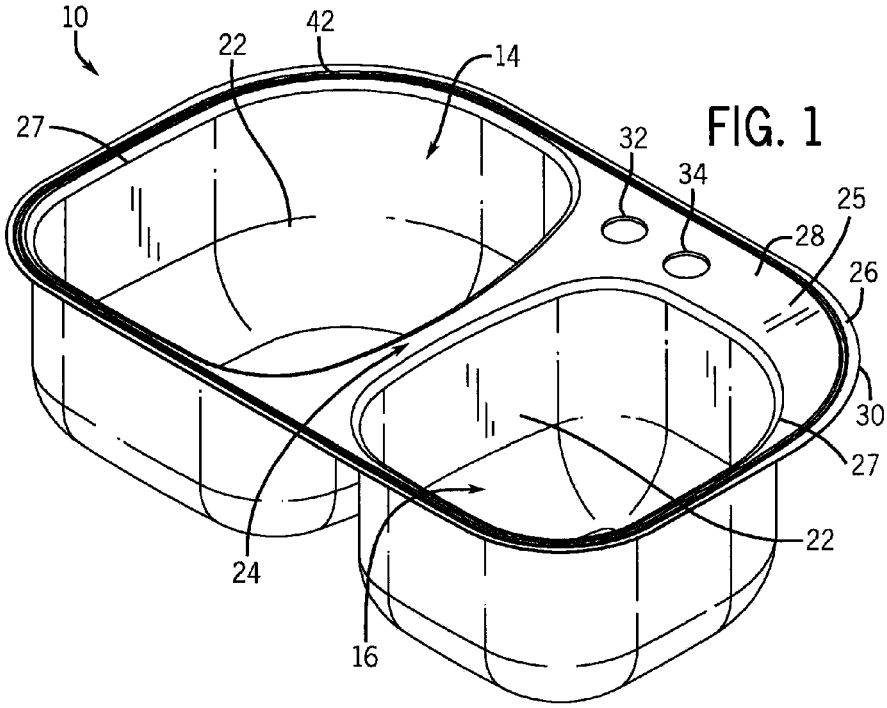
FIG. 1 is a perspective view of an exemplary embodiment of a sink of FIG. 1.

Referring generally to the FIGURES, an exemplary embodiment of an undercounter mountable sink 10 and an assembly 12 incorporating the sink 10 are illustrated.

According to an exemplary embodiment, the sink is a stainless steel sink including a rim. At least one channel or recessed portion is integrally formed in the rim to provide a number of benefits, including, but not limited to inhibiting and/or reducing warping (e.g., ripples, non-planar portions, undulations, etc.) of the rim and, more generally, strengthening the stainless steel sink (e.g., by providing a stiffening geometry). The improved planarity of the rim facilitates the convenient and hassle-free installation of the sink and any plumbing fixtures, especially when the sink includes a faucet deck for direct mounting the faucet to the sink. In some exemplary embodiments, the channel is integrally formed in a mounting portion of the rim.

Further, channel may also provide a receptacle for receiving a sealant, such as silicone caulk. Among other benefits, such a feature can improve the speed and cleanliness of installation of the sink. Further, another formed feature, such as a protrusion (e.g., an integrally formed protrusion), can be used to help locate coupling or mounting elements during installation. These and other benefits are discussed in more detail below.

Referring to FIGS. 1 through 5, the sink 10 is shown as a stainless steel, dual basin sink including a first or left side basin 14 and a second or right side basin 16, according to an exemplary embodiment. At a bottom of each of the basins 14, 16, there are drain openings 18, 20, respectively, which can be coupled to outlet plumbing (not shown). Walls 22 extend generally upwardly and outwardly from the drain openings 18, 20 to define the basins 14, 16. The two basins 14, 16 are shown disposed generally side-by-side and are separated by a centrally located saddle 24. Dual basin sinks are particular useful in a kitchen because each basin can be dedicated to a different purpose. For example, one of the basins can be dedicated to washing dishes, while the other basin can be dedicated to rinsing dishes. According to other exemplary embodiments, however, an undercounter sink could have a different number, size, and/or shape of basins and/or could be used in an environment other than a kitchen. For example, in a bathroom or lavatory, it may be preferable that the sink only have a single basin.

Referring further FIGS. 1 through 5, the sink 10 also includes a rim 25. The rim 25 extends generally outwardly from the walls 22 that define the basins 14, 16 and includes a mounting portion 26. As shown, the basins 14, 16 meet or transition to the rim 25 at upper edges or boundaries 27. The mounting portion 26 is configured to facilitate mounting the sink 10 to a counter, as will be discussed in more detail below. While the rim 25 is shown as a flange that generally horizontally extends away from the upper edges or boundaries of the basins 14, 16; according to other exemplary embodiments, the rim 25 may not be a flange, but rather, may have another generally outwardly extending structure.

Figure 2:
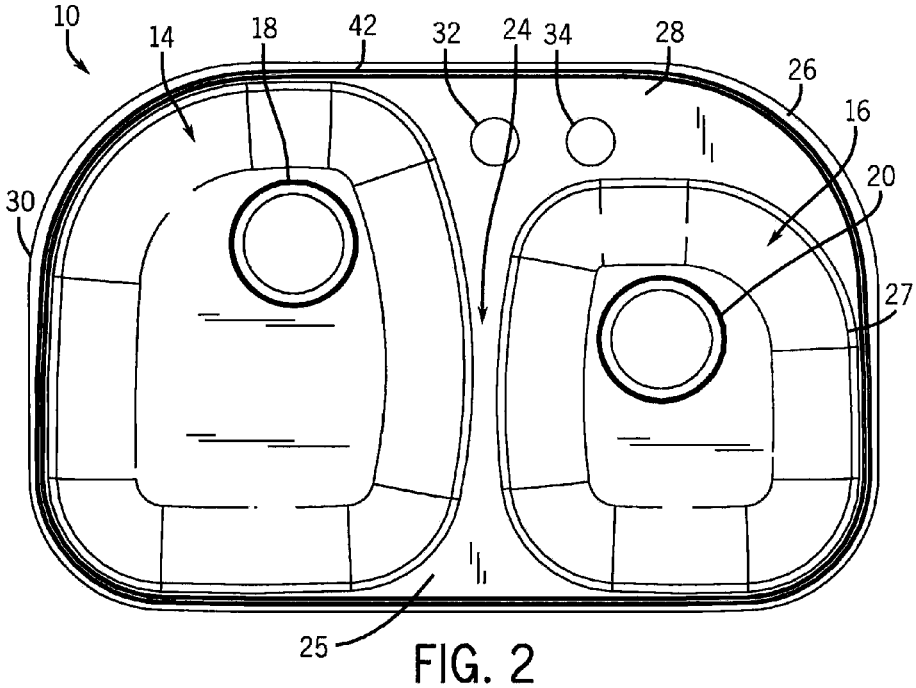
FIG. 2 is a top plan view of the sink of FIG. 1.
Figure 3:
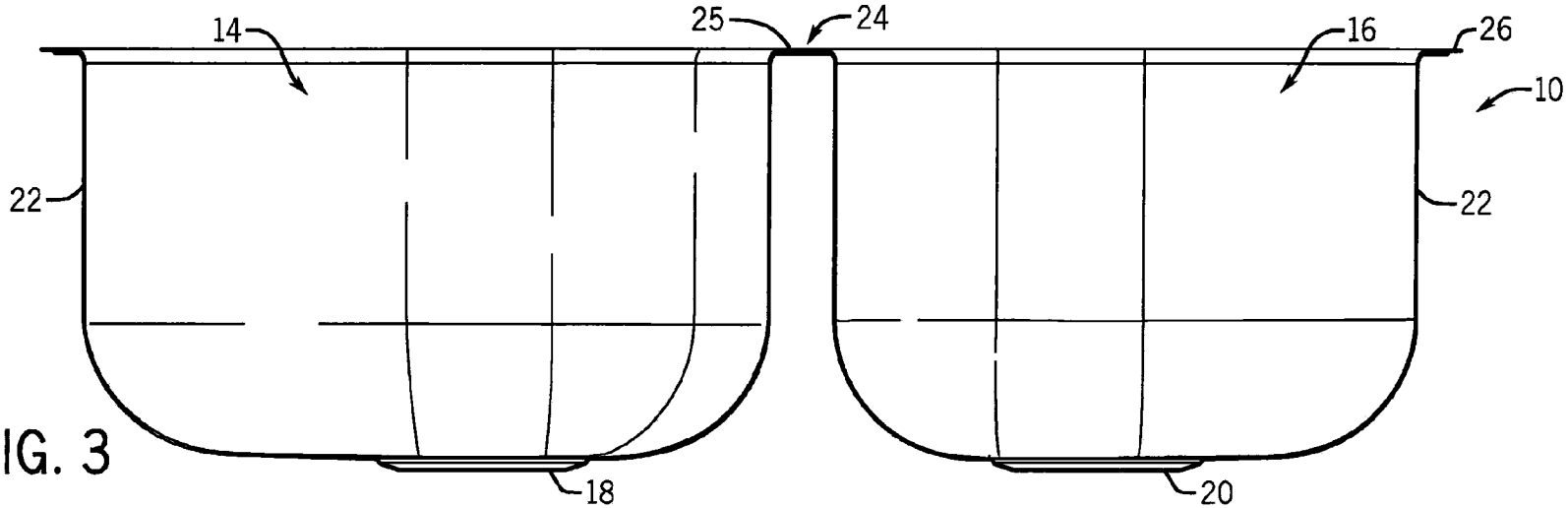
FIG. 3 is a front elevation view of the sink of FIG. 1.

Referring to FIGS. 1-2, the sink 10 further includes an integrated faucet deck or platform 28 according to an exemplary embodiment. The faucet deck is shown disposed generally between the upper edges of the basins 14, 16 and an outer periphery 30 of the rim 25. The faucet deck 28 includes one or more holes, shown as pre-formed holes 32 and 34, configured to receive one or more water distribution elements or controls (e.g., a faucet, a sprayer, etc.). The faucet deck 28, by providing for these components to be mounted directly to the sink, substantially avoids difficulty of locating, aligning, and drilling holes in a counter at the site of installation. Further, this configuration helps decrease the risks associated with cutting holes in a counter on site, with transporting a counter with holes already cut therein, etc.

In the exemplary embodiment shown, the faucet deck 28 is more specifically located rearwards of the right side basin 16, which is smaller than left side basin 14. The pre-formed holes 32 and 34 may receive a faucet and/or sprayer (not shown) that is positionable over the basins 14 and 16 to supply water. The faucet head may be capable of swinging such that the faucet head is positionable over either one of the basins or neither of the basins. In this way, water could be supplied to either basin and, further, the faucet head can be cleared from an area above a selected basin so as to provide clearance for the insertion of large objects (such as for example, a large pot) into the selected basin.

According to other exemplary embodiments, the faucet deck may be formed/located at substantially any location suitable for locating one or more water distribution elements or controls.

Although the faucet deck 28 is shown as part of (e.g., integral with) the sink 10 in the exemplary embodiment shown, in other exemplary embodiments, there may be no faucet deck or the faucet deck may be differently positioned relative to the basin or basins. For example, as illustrated, the upper surface of the faucet deck 28 is generally co-planar with the upper surface of the rest of the rim 25 (except for the channel, as will be described in more detail below); however, according to other exemplary embodiments, the faucet deck could be downwardly or upwardly offset from the plane of the upper surface of the rest of rim, angled in part or in whole (e.g., to avoid the collection of water at the rim), and/or include multiple levels. According to still other exemplary embodiments, there may be more than one faucet deck.

Figure 4:
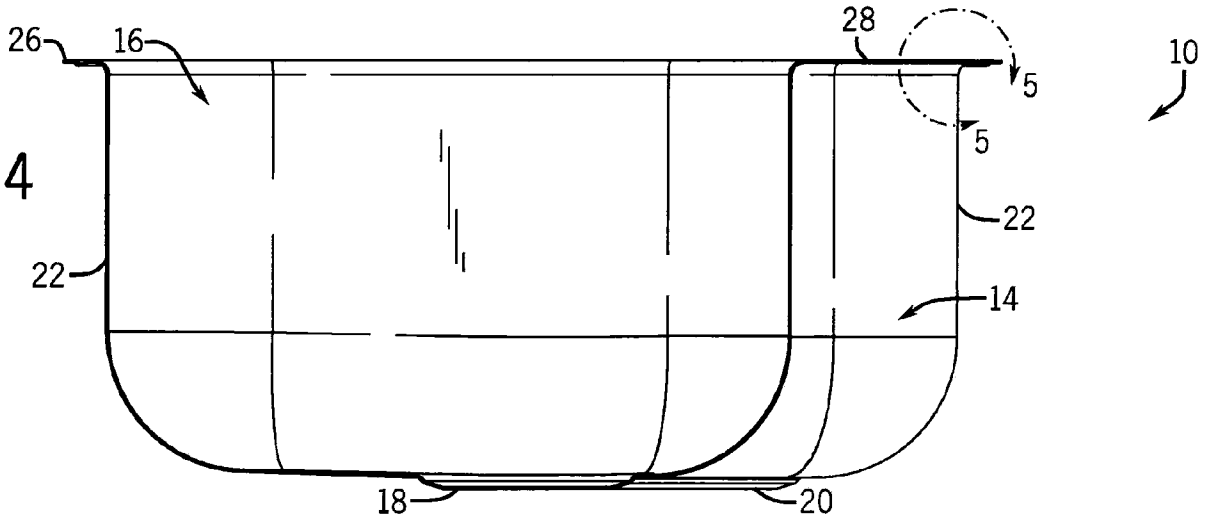
FIG. 4 is a right side elevation view of the sink of FIG. 1.
Figure 5:
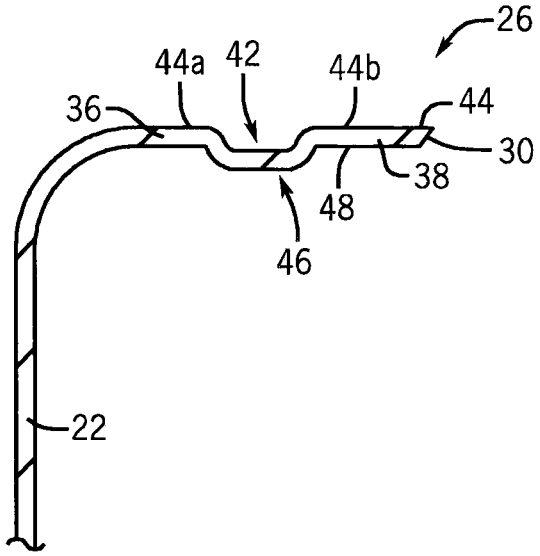
FIG. 5 is a detailed sectional view taken through the region defined by line 5-5 of FIG. 4.
Figure 6:
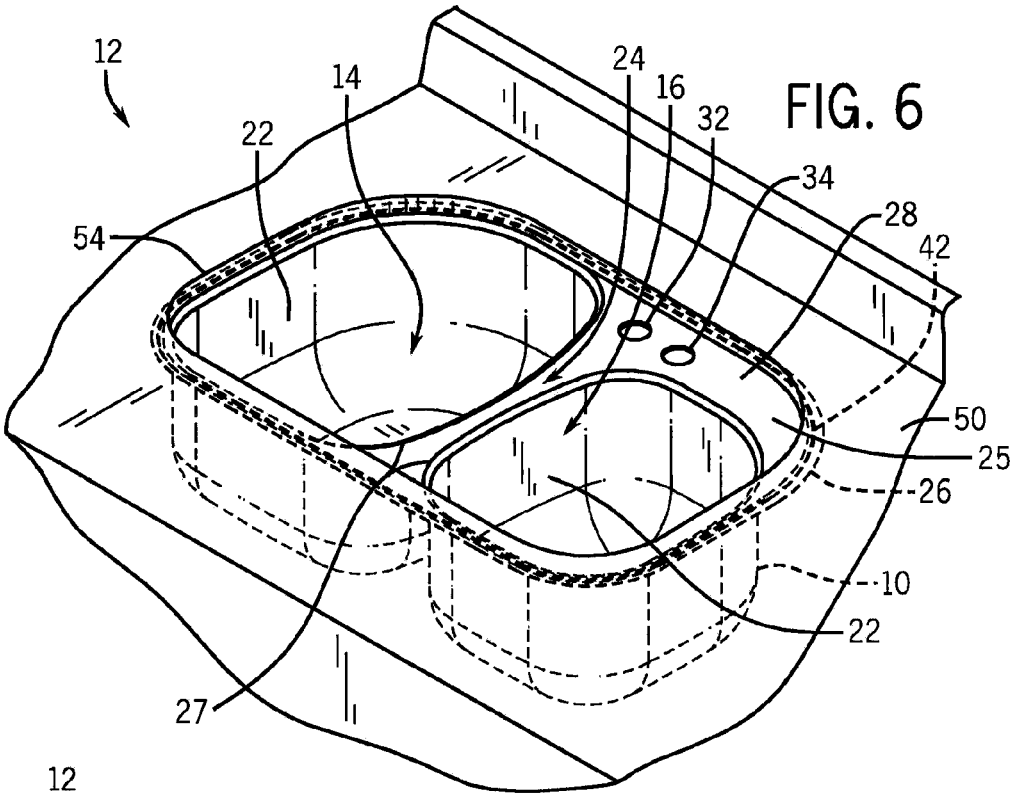
FIG. 6 is a perspective view of an assembly including the exemplary embodiment of the sink from FIG. 1.
Figure 7:
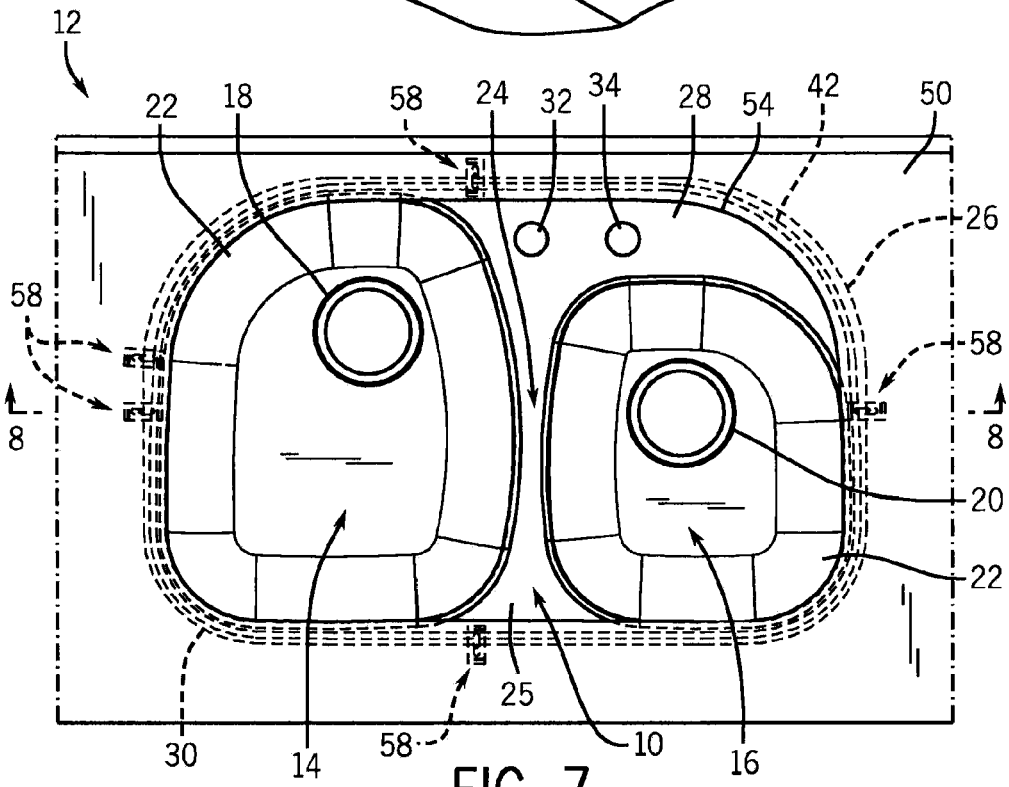
FIG. 7 is a top plan view of the assembly of FIG. 6.

As discussed above, the rim extends generally horizontally away from the basin(s). Referring in particular to FIGS. 4-5, it can be seen that the rim 25 includes a channel 42 formed at the mounting portion 26, which is intended to be located generally under a counter when the sink 10 is installed. A first or inner portion 36 of the mounting portion 26 of the rim 25 is shown located generally adjacent and interior to the channel 42. A second or outer portion 38 of the mounting portion 26 of the rim 25 is shown located generally adjacent and exterior to the channel 42. In the exemplary embodiment shown, the rim 25 is of substantially constant thickness and is generally downwardly formed (e.g., pressed, stamped, drawn, etc.) to define the channel 42 such that the channel is substantially recessed relative to an upper surface 44 of the rim 25 (i.e., faces/opens generally upwardly as-installed). According to some exemplary manufacturing processes, formation of the channel 42 also results in formation of a protrusion 46 extending generally downward from an underside or lower surface 48 of the rim 25.

Accordingly, the channel 42 (e.g., recess, groove, cavity, generally elongated recessed portion, etc.) and the protrusion 46 are disposed generally between the upper edges 27 of the basins 14, 16 and the outer periphery 30 of the rim 25. Further, in the form shown, the channel 42 is generally disposed outward of the faucet deck 28, which is intended to be accessible when the sink 10 is installed.

Referring generally to FIGS. 6-9 and 5, to help to ensure good contact is made between the upper surface 44 of the rim 25 and the underside of the counter, it is desirable for the rim 25, or at least the portion(s) of the upper surface 44 thereof intended to contact the underside of the counter, to be substantially planar.

According to an exemplary embodiment, the portions of the upper surface 44 on either side of the channel 42 (i.e., inward and outward of the channel 42) are both configured to contact a generally planar underside of a counter and to be substantially flush therewith according to an exemplary embodiment. Referring to FIG. 5, a first portion 44*a* of the upper surface 44 of the rim 25 (generally corresponding to the inner portion 36 of the mounting portion 26 of the rim 25) is substantially co-planar with a second portion 44*b* of the upper surface 44 of the rim 25 (generally corresponding to the outer portion 38 of the mounting portion 26 of the rim 25). The channel 42 is recessed generally downward relative to these portions 44*a* and 44*b*, and, as shown, relative to the upper surface 44 of the rim 25 more generally.

In the exemplary embodiment shown, the channel 42 extends around the rim 25, forming a closed loop around (e.g., encircling, enclosing, surrounding, etc.) the basins 14, 16. In other exemplary embodiments, however, the channel 42 may not be a closed loop, but rather may extend around only a portion of the rim and/or there may be more than one channel (e.g., each channel at a different location of the mounting portion of the rim). If a faucet deck 28 is present, the channel 42 preferably extends at least along the portion of the rim 25 generally between the faucet deck 28 and the outer periphery 30 of the rim 25. Forming a channel that extends at least substantially along this portion of the rim helps strengthen the faucet deck and reduce (e.g., prevent, correct, inhibit, etc.) warping thereof. In this way, the channel can significantly improve the ease of coupling (e.g., mounting, securing, etc.) a fluid distribution or control element to the faucet deck, an installation step that can be significantly complicated by warping or other planarity issues with the faucet deck. More generally, channels may be particularly beneficial when disposed proximate to sink/rim locations (portions, areas, sections) that are relatively more susceptible to warping or other planarity issues, weakness, etc.

In the exemplary embodiment shown, the channel 42 is shown spaced a distance from the outer periphery 30 of the rim 25 that is substantially constant. According to other exemplary embodiments, the channel (or portions thereof) need not be spaced a constant distance form the outer periphery 30 of the rim 25. More generally, the path of the channel (or portions thereof) need not substantially correspond to the shape of the outer periphery of the rim. For example, portions of the channel may curve inward or outward at one or more locations.

Figure 8:
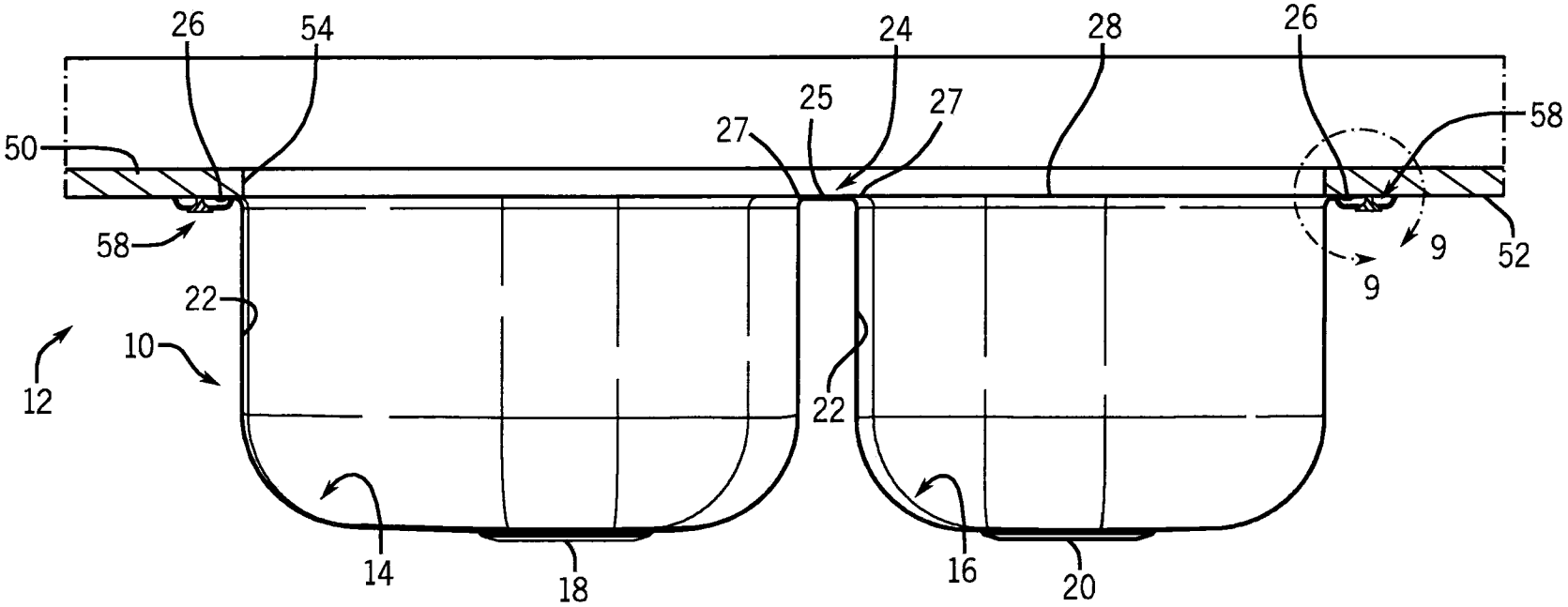
FIG. 8 is a cross-sectional view taken through line 8-8 of FIG. 7.
Figure 9:
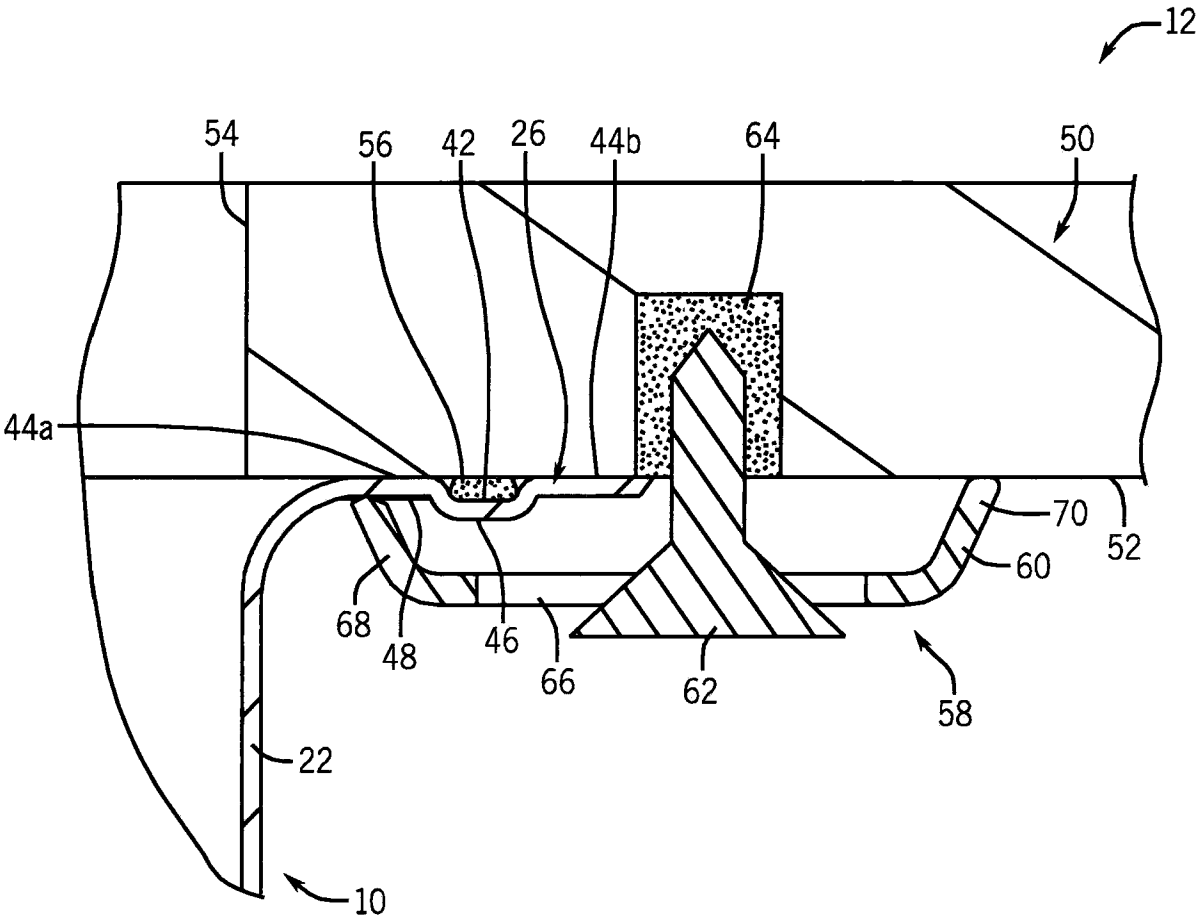
FIG. 9 is a detailed sectional view of the region defined by line 9-9 of FIG. 8.

Referring to FIGS. 8-9, the channel 42 may be further configured to receive a sealant, such as a silicone caulk, as will be discussed in more detail below.

In the exemplary embodiment shown, the sink 10 is shown made of stainless steel, for example, an 18-gauge stainless steel which contains alloyed nickel additions and is formed using a deep drawing process. However, according to other exemplary embodiments, any metal/metal alloy that can be formed into a sink using a drawing process may be used.

The methods of manufacturing a sink according to this disclosure will now be discussed in more detail.

As discussed above, the manufacturing process for sink 10 includes a drawing process according to an exemplary embodiment. The drawing process may include one draw step or multiple draw steps. According to one exemplary embodiment, the basins 14, 16 of the sink 10 may be substantially formed with a single draw. According to another exemplary embodiment, the basin(s) may be substantially formed in two draws. According to some exemplary embodiments, more than two draws are used to form the basin(s).

In the exemplary embodiment shown, the sink 10 has large, generous corner radii (e.g., 2 inches, 1.25 inches, more than 2 inches, etc.) which provide for improved flow of material during the drawing process, thereby eliminating or minimizing the need for additional draw steps (e.g., at least both basins of the sink might be drawn in a single draw step). It should be noted that the size and/or shape of the radii may be varied and still provide the above-mentioned benefits during the drawing process.

Either after the drawing process used to form the basins or simultaneously with this drawing process, the channel 42 is formed in the mounting portion 26 of the rim 25 by press molding, drawing, stamping, or the like. In the exemplary embodiment shown, the rim 25, which is otherwise generally planar, is deformed after the drawing process using a pressing process (e.g., employing a trim and drain tool) to form the channel 42 (and, thereby, substantially defining the inner section 36 and the outer section 38 of the mounting portion 26 of the rim). As the channel 42 is formed, the warping is substantially corrected (e.g., as warped portions are pulled flat/planar, etc.).

As shown, the channel 42 is generally symmetric with two downwardly sloping walls meeting at a substantially flat, base or bottom wall. Although a specific channel geometry is depicted, the channel 42 could have other shapes, sizes, and/or configurations (e.g., the channel need not be symmetrical). According to another exemplary embodiment, the channel includes two generally vertical walls joined by a generally horizontal base or bottom wall. According to some exemplary embodiments, the channel is generally V-shaped or generally U-shaped. Further, while the channel is shown having a substantially constant width and a substantially constant depth, according to other exemplary embodiments, the width and/or depth of the channel may vary at one or more locations/portions of the sink. For example, the channel may be wider proximate to the faucet deck.

As the rim 25 may be relatively thin (e.g., as measured from top to bottom), the formation of the channel 42 in the rim 25 may simultaneously form the protrusion 46. In alternative embodiments, however, forming a channel may not result in a protrusion, but, rather, the channel may simply extend a distance downward relative to the upper surface of the rim (or a portion thereof), with any lower or underside surface of the rim being substantially not affected by the formation of the channel. This may be the case, for example, if the rim is relatively thick.

Typically, when a stainless steel sink of the type described is formed, the rim of the sink is, at least to some degree, warped as a result of the drawing process (e.g., because of a differential draw performed across various segments of the sink). Warping of the rim may complicate installation of the sink because, among other things, the rim is not easily positioned to be flush with the underside of the counter during installation. Often, this warping must be addressed (e.g., overcome, corrected, etc.) in the field/during installation to improve the contact between the rim (or portions thereof) and the underside of the counter. To overcome warping (e.g., counteract, straighten out, etc.), the rim may be secured to the counter at a large number of locations and/or using a large number of mounting elements (e.g., by clips, etc.), adding time and expense to the installation process. Warping of a faucet deck complicates directly mounting one or more water distribution elements and/or controls thereto.

The inventors were surprised to find that by forming the channel in the mounting portion of the rim, the strength of the rim was significantly improved (e.g., the rim was generally stiffened) and warping of the rim and faucet deck was significantly reduced, generally resulting in improved planarity/flatness of the rim. Improved planarity/flatness of the rim significantly improved the ease of installation of the sink under a counter and ease of coupling (e.g., mounting) one or more water distribution elements and/or controls to a faucet deck (if present).

Referring now to FIGS. 6 through 9, the exemplary sink assembly 12 includes the sink 10 mounted to a counter or countertop 50, according to an exemplary embodiment. In particular, the sink 10 is mounted to an underside 52 of the counter 50 such that a hole 54 in the counter 50 provides access through the counter 50 to the basins 14, 16 and at least a portion of the mounting faucet deck 28 of the sink 10. Notably, unlike a top-side sink installation, in which a sink is dropped in from above the counter and a rim of the sink obscures the cutout of the hole, the sink 10 is disposed and mounted substantially below the counter 50, making the sink-hole alignment more significant.

Referring in particular to FIG. 9, the channel 42 receives a sealant 56 before being coupled to the counter 50, such as, for example, a silicone caulk. Although the channel 42 is recessed relative to portions 44*a* and 44*b* of the upper surface 44 of the rim 25, the sealant 56 may be initially disposed in the channel 42 in such a manner that a bead of the sealant 56 will initially extend past the upper surface 44 of the mounting portion 26 of rim 25.

The rim 25 of the sink 10 is then moved into contact with the underside 52 of the counter 50 and the sealant 56, according to the exemplary embodiment shown, to form a seal between the counter 50 and the rim 25. As the portions 44*a*, 44*b* of the upper surface 44 of the mounting portion 26 of rim 25 are moved into contact with the underside 52 of the counter 50, the sealant 56 may to some extent flow laterally (i.e., toward the basin(s) and/or toward the outer periphery 30 of the rim 25) in the channel 42. According to some exemplary embodiments, the channel 42 and/or sealant application may be configured to have a width sufficient to prevent the sealant 56 from oozing out from the channel 42, thereby maintaining a relatively clean-looking installation while simultaneously establishing a robust seal of sufficient area.

Once the sink 10 is sealed to the underside 52 of the counter 50, one or more coupling or mounting elements 58 may be used to help support (e.g., anchor, hold, mount, fasten, retain, etc.) the sink 10 in place relative to the counter 50. In the exemplary embodiment of the assembly 12 shown, five mounting elements 58 are shown disposed at various locations about the rim 25 of the sink 10. However, it will be readily appreciated that other numbers of mounting elements 58 and/or other types of coupling or mounting elements could be employed. Generally, the improved planarity of the rim allows fewer coupling or mounting elements to be used (e.g., because the coupling or mounting elements do not necessarily have to also help counter/correct warping of the rim, etc.).

Each mounting element 58 includes a mounting clip 60 that is coupled to the counter 50 by driving a screw or other fastener 62 into a deformable anchor 64 according to an exemplary embodiment. The deformable anchor 64 is disposed (e.g., inserted, etc.) into the underside 52 of the counter 50. The body or shaft of the screw 62 passes through a slit 66 in the mounting clip 60 and the head of the screw 62 is of such a size that it catches on the sides of the mounting clip 60 as the screw 62 is tightened down. The mounting clip 60 is shown substantially U-shaped, having two generally upwardly hooked ends. One hooked end 70 is intended to contact the underside 52 of the counter 50 (and is located generally outward of the sink 10) and the other hooked end 68 is intended to catch or engage the lower surface 48 of the rim 25 of the sink 10 (shown located generally interior to the channel 42).

As the screw 62 is tightened, the hooked end 68 is drawn into engagement with the lower surface 48 of the rim 25, and, in particular, to a portion of the lower surface 48 disposed generally between the wall of the basin proximate thereto and the protrusion 46. The protrusion 46 may help locate the hooked end 68 of the mounting clip 60 (e.g., "fencing in" the hooked end 68 so that it is not easily pulled or otherwise moved outward beyond the protrusion). This, in part, helps to roughly locate the sink 10 relative to the counter 50, even prior to fully clamping down the mounting clips 60.

Accordingly, a sink is provided with a number of benefits relating to its fabrication and installation. Among other things, the rim and any faucet deck thereof of the sink exhibit exceptional strength and planarity for a drawn sink. Generally, as warping is reduced, fewer mounting elements need to be used to ensure that the sink is flush with the underside of the counter and that features/portions of the rim, such as the faucet deck, are also sufficiently planar to support water distribution and/or control elements and the like. Further, the need for drill holes in the counter at the site of installation can be avoided.

Moreover, the forming step which is used to strengthen the rim creates a channel and a protrusion. The channel can advantageously receive and neatly contain a sealant and the protrusion can advantageously be used locate or "fence" in the sink during installation.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

It should be noted that the orientation of various elements may differ according to other exemplary embodiments, and that such variations are intended to be encompassed by the present disclosure.

It is also important to note that the construction and arrangement of the sink and sink assembly as shown in the various exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter disclosed herein. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present invention as defined in the appended claims. The order or sequence of any process or method steps may be varied or re-sequenced according to alternative embodiments. Other substitutions, modifications, changes and omissions may be made in the design, operating conditions and arrangement of the various exemplary embodiments without departing from the scope of the present inventions.

What is claimed is:

1. A sink mountable to an underside of a counter, the sink comprising:

at least one basin; and a rim extending generally outwardly from an upper boundary of the basin, wherein the rim includes:

at least one channel recessed relative to an upper surface of the rim; and at least one protrusion extending generally downwards relative to a lower surface of the rim, the at least one protrusion positioned generally beneath the at least one channel;

wherein the upper surface of the rim includes a first portion generally exterior relative to the at least one channel and a second portion generally interior relative to the at least one channel;

wherein the first and second portions are substantially coplanar with the underside of the counter when the sink is mounted thereto.

2. The sink of claim 1, wherein the sink is a drawn, stainless steel sink.

3. The sink of claim 1, wherein the at least one channel is a strengthening element.

4. The sink of claim 1, wherein the at least one channel is integrally formed in the rim.

5. The sink of claim 1, wherein the rim further includes at least one mounting portion, the at least one channel being formed in the at least one mounting portion.

6. The sink of claim 1, wherein the at least one channel reduces warping of the rim.

7. The sink of claim 1, wherein the at least one channel forms a closed loop around the at least one basin.

8. The sink of claim 1, wherein the at least one channel extends only partially around the at least one basin.

9. The sink of claim 5, wherein a plurality of channels extend along the mounting portion of the rim.

10. The sink of claim 1, wherein the rim further includes a faucet deck disposed generally between a portion of the upper boundary of the at least one basin and an outer periphery of the rim.

11. The sink of claim 10, wherein the at least one channel extends at least along a portion of the mounting portion of the rim generally corresponding to the faucet deck.

12. An assembly comprising:

a counter having an underside; and a sink mounted to the underside of the counter, the sink including:

at least one basin; and a rim extending generally outwardly from the basin;

wherein the rim includes at least one channel recessed relative to an upper surface of the rim, at least one protrusion extending generally downwards from a bottom surface of the rim, the at least one protrusion positioned generally beneath the at least one channel, a first portion generally exterior to the at least one channel, and a second portion generally interior to the at least one channel;

wherein the first and second portions are substantially parallel with the underside of the counter when the sink is mounted thereto.

13. The assembly of claim 12, wherein a sealant is received in the at least one channel, the sealant helping to form a seal between the rim and the underside of the counter.

14. The assembly of claim 12, wherein the rim is substantially planar.

15. The assembly of claim 12, wherein the sink is supported with respect to the counter by at least one mounting element, the at least one mounting element positioned at least partially over the protrusion and generally below the channel.

16. A method of installing a sink to an underside of a counter, the method comprising:

providing a sink including:

at least one basin; and a rim extending generally outward from an upper boundary of the at least one basin to an outer periphery, the rim including:

an upper surface;

a mounting portion; and at least one channel recessed relative to a portion of the upper surface generally corresponding to the mounting portion of the rim, the at least one channel positioned between the upper boundary of the at least one basin and the outer periphery of the rim; and positioning the sink such that the mounting portion of the rim substantially contacts the underside of the counter.

17. The method of claim 16, further comprising the step of placing a sealant in the at least one channel before positioning the sink such that the mounting portion of the rim substantially contacts the underside of the counter.

18. The method of claim 16, further comprising using at least one mounting element to help support the sink relative the counter, wherein the at least one mounting element includes a first end in contact with the underside of the counter and a second end in contact with a bottom surface of the rim at a location generally interior relative to the at least one channel.

19. A method of manufacturing a sink configured to be mounted to an underside of a countertop, the method comprising:

providing a stainless steel sheet;

drawing the stainless steel sheet to form at least one basin and a rim extending generally outwardly from an upper boundary of the basin; and forming a channel in a mounting portion of the rim, the channel being recessed relative to an upper surface of the rim;

wherein the step of forming the channel further includes minimizing warping of the upper surface of the rim.

20. The method of claim 19, wherein the steps of drawing the stainless steel sheet and forming the channel occur substantially simultaneously.

21. The method of claim 19, wherein the steps of drawing the stainless steel sheet and forming the channel occur generally sequentially.

22. The method of claim 19, wherein a basin having at least some large corner radii is formed during the step of drawing the stainless steel sheet to form at least one basin and a rim, thereby improving the flow of stainless steel during the drawing step.

23. The method of claim 19, further comprising mounting one or more water distribution elements or water distribution controls to a faucet deck, the faucet deck being part of the rim.

* * * * *